US005909863A

United States Patent [19]

Mansfield et al.

[11] Patent Number: 5,909,863

[45] Date of Patent: Jun. 8, 1999

[54] SUPPORT TUBE, SUPPORT TUBE SURFACE AREA ASSEMBLY, AND METHOD FOR MANUFACTURE OF THE SUPPORT TUBE

[75] Inventors: Michael T. Mansfield, Mundelein; Ronald L. Wood, Jr., Barrington, both of Ill.

[73] Assignee: B & W Corporation, Bensenville, Ill.

[21] Appl. No.: 08/887,660

[22] Filed: Jul. 3, 1997

[51] Int. Cl.[6] ..... A47G 29/02

[52] U.S. Cl. ..... 248/235; 108/91; 211/182; 211/188; 248/351; 411/383; 411/384; 411/389

[58] Field of Search ..... 248/351, 235, 248/239, 250; 211/188, 182; 108/91, 93; 403/282, 274; 411/383, 384, 389

[56] References Cited

U.S. PATENT DOCUMENTS 2,290,535 7/1942 Cavins ..... 248/235
3,834,549 9/1974 Burg et al. ..... 211/182 X
4,040,463 8/1977 Petrus ..... 248/239
5,695,081 12/1997 Alkaly ..... 211/188 X

*Primary Examiner*—Ramon O. Ramirez
*Attorney, Agent, or Firm*—James P. Hanrath

[57] ABSTRACT

A support tube for use with a support tube surface area assembly such as a shelf, a portion of a furniture article, or other structure, comprises a first end, a body section, and a second end. The first end and second end of the support tube are outwardly flared to provide a tapered interior area into which a first and a second accessory element, such as a nut and bolt, may be inserted. The accessory elements are enclosed in the tapered interior area by a crimping and flattening of the lips of the first and second end such that they form an interiorly extending flange partially encapturing the accessory elements. A method for making the support tube is disclosed as well a shelf structure or furniture article assembled with the support tube.

28 Claims, 5 Drawing Sheets

FIG. 2
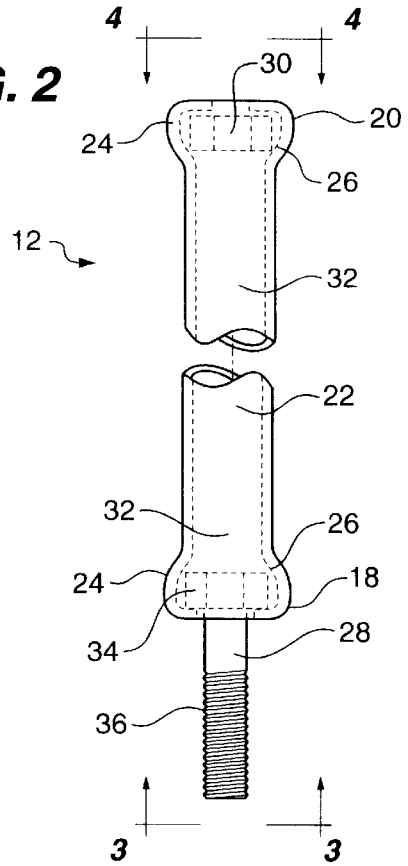
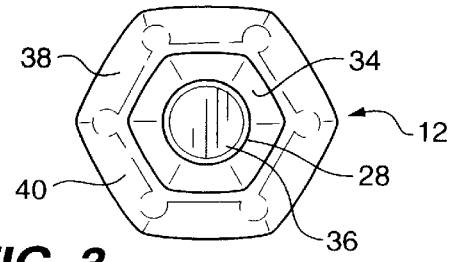
FIG. 3
FIG. 4
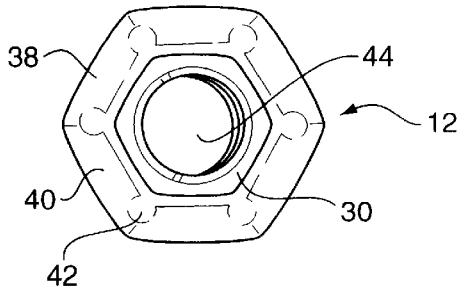
FIG. 5A
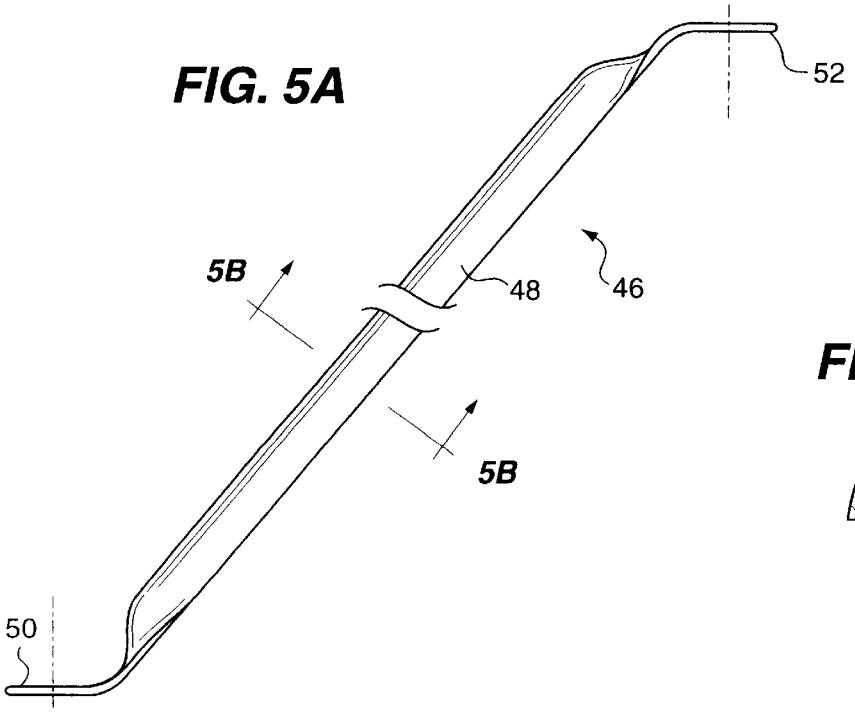
FIG. 5B
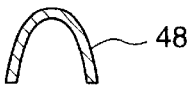

SUPPORT TUBE, SUPPORT TUBE SURFACE AREA ASSEMBLY, AND METHOD FOR MANUFACTURE OF THE SUPPORT TUBE

BACKGROUND OF THE INVENTION

1. Field of the Invention

The present invention relates generally to support rods or tubes, particularly to a support tube for a surface area such as a shelf assembly or a portion of a furniture, and provides a method for the manufacture of the support tube and the assembly of the same with a surface area such as a shelving or furniture structure.

2. Description of the Related Art

Traditionally, surface areas such as a shelving unit have a variety of vertical wall supports, side walls, cantilever brackets, column, wall, or other means for supporting the same. Likewise articles of furniture have a variety of leg, side wall, wall, column, and support components to aid in the support of a surface area. Often such means require fixed support walls and independent screws, nuts, bolts, or other independent attachment pieces, and associated tools of assembly, to accomplish the support of a surface area.

Although some bracket/wall standard systems, shelving units, and articles of furniture are designed to be permanent installations, the changing commercial, merchandising display, or home or office decor needs of users make it desirable that the support members for surface areas of shelving units or load bearing portion of articles of furniture be able to be changed and rearranged between multiple positions or in a modular manner with relative ease and economy and without damage. Accordingly, ease of installation, flexibility of support member settings, portability, modular capability, secure engagement of the support member, ease in disengagement, as well as the cost and ornamental or sightliness appearance of the support member are important factors in modern integrated merchandising, storage, commercial, office, or home surface area structures.

SUMMARY OF THE INVENTION

In accordance with the present invention there is provided a support tube for a surface area such as a shelf assembly or furniture article and a manufacturing process for making the support tube. The support tube comprises a first end, a body section, and a second end. The first end and second end of the support tube are outwardly flared to provide a tapered interior area adjoining the first and second ends which terminate into a lesser diameter angular ring which defines an arbitrary length body section of the support tube. A first accessory element, such as a bolt, is set and enclosed within the tapered interior area of the first end while a second accessory element, such as a nut, is set and enclosed within the tapered interior area of the second end.

The support tube can be an important component for the support of a surface area such as an assembled shelving unit or bookcase, or other furniture article, such as the compartmental sections of a computer work station, hutch, desk or the like, wherein a surface area has cooperative bores to receive or cooperate with an accessory element of a completed support tube so as to foster attachment of the support tube in an position for support. Indeed, the support tube can be used in a wide variety of assemblies wherein it is attached to a surface area, for example as a support, a brace, or a tie rod.

The method for manufacture of the support tube comprises the steps of flaring both ends of a cylindrical tube to thereby form a flare tube having a first end, a body section, and a second end wherein each of the ends are outwardly flared to provide a tapered interior area adjoining the first and second ends which terminates into a lesser diameter annular ring that defines the arbitrary length body section of the support tube. Then a first accessory element, such as a bolt, is placed into one end of the flare tube, and a second accessory element, such as a nut, is placed into the other end of the flare tube, both to a predetermined depth within the tapered interior area of each end of the flare tube due to the lesser diameter of the body section, prior to a crimping of a portion of each end of the tube partially over the associated accessory element so as to capture the same in a crimped tube. Finally, a flattening of the lip of outer ends of the crimped tube flattens the lip to partially extended over each of the associated accessory elements thereby permanently locking them in place within the flared end section of the support tube.

The present invention advantageously provides a support tube for use in a shelf assembly or other furniture or structure which does not require independent screws, nuts, bolts or other accessory elements, and associated tools of assembly, be used with the support tube. The support tube is an integral, ready to use, modular component piece designed for cooperation with bores of a surface area, a shelf, a panel, a furniture piece, or other structure to form a support or tie rod or brace for the same in a standardized fashion.

The support tube of the present invention provides additional strength and security to a shelf or other furniture or structure assembly in that the accessory elements used with the support tube are retained therein and protected thereby. A failure of the structural support achieved by the support tube would require a destruction of the enclosing flange guarding and giving additional strength to the accessory element.

Still further, the great variety in the type and combinations of associated accessory elements used with the support tube provides flexibility in environmental usage of the support tube as a modular component piece in a wide variety of assemblies while maintaining a pleasing streamlined ornamental appearance of the support tube.

Additional features and advantages of the present invention will become apparent to those skilled in the art from the following description and the accompanying figures illustrating preferred embodiments of the invention, the same being the present best mode for carrying out the invention.

BRIEF DESCRIPTION OF THE DRAWINGS

FIG. 2 is a side view of a support tube shown in FIG. 1.

FIG. 3 is bottom view of the support tube illustrated at FIG. 2 taken along line 3—3 of FIG. 2.

FIG. 4 is a top view of the support tube illustrated at FIG. 2 taken along line 4—4 of FIG. 2.

FIG. 5A is a side view of a cross piece member designed for cooperation with a pair of support tubes and FIG. 5B is a cross-sectional view of a middle portion of the cross piece member taken along line 5B—5B of FIG. 5A.

DESCRIPTION OF THE PREFERRED EMBODIMENTS

Figure 1:
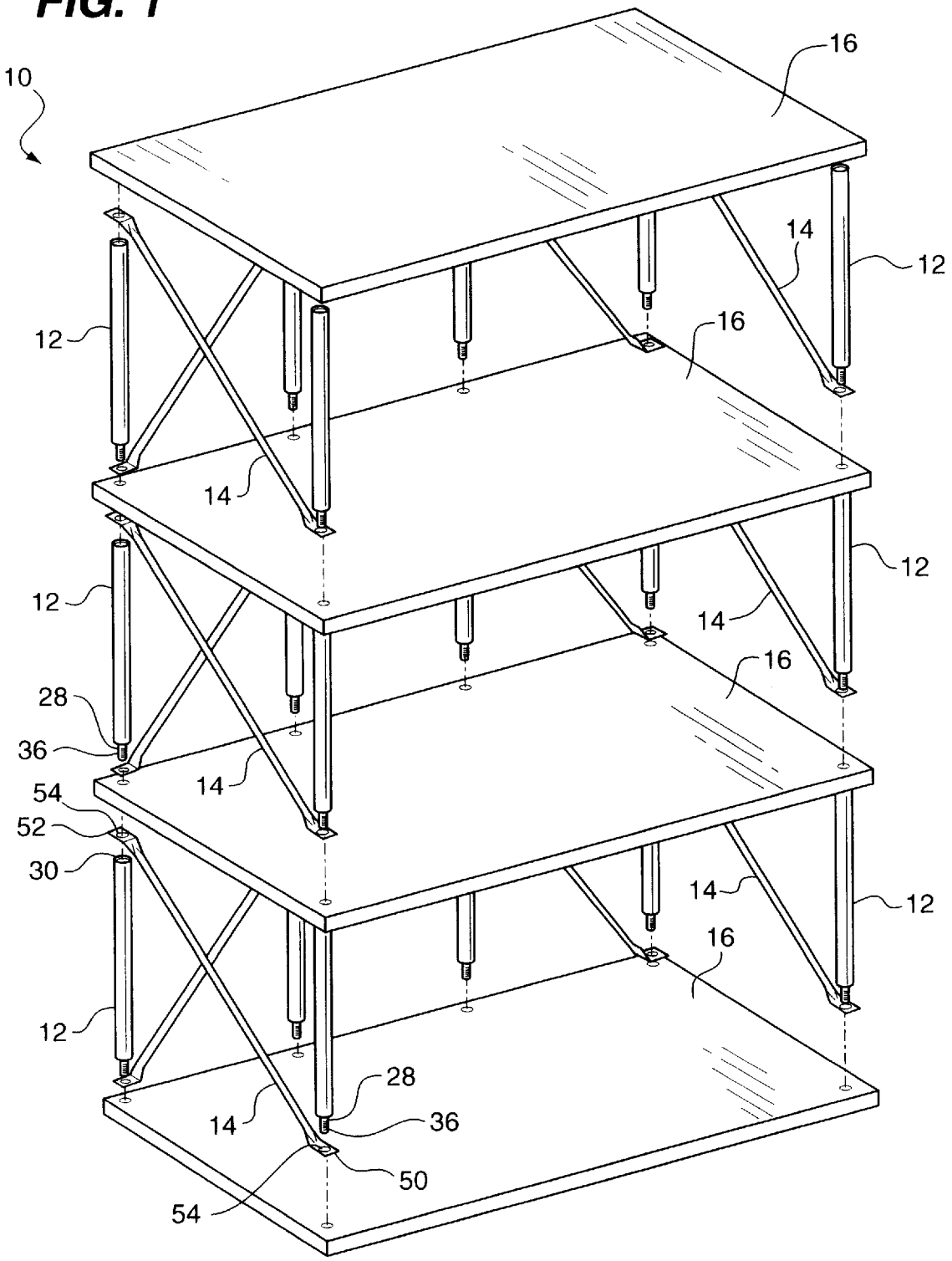
FIG. 1 is a perspective view of a support tube shelf unit assembly constructed in accordance with teachings of the present invention with components thereof exploded.

Referring now to the drawings, there is shown in FIG. 1 a bookcase or shelf assembly 10 comprised of a plurality of support tubes 12, cross piece members 14, and shelf boards 16. Bookcase or shelf assembly 10, although a preferred exemplary embodiment, is merely representative of many types of surface area assemblies which may use support tubes 12 of the present invention.

As better observed in the side view of FIG. 2, the support tube 12 comprises a first end 18, a second end 20, and a body section 22 extending a predetermined arbitrary distance therebetween. The first end 18 and second end 20 are each outwardly flared at their external periphery 24 to provide a tapered interior area 26 to the first end and the second end. A first accessory element, such as a bolt 28, is set within the tapered interior area 26 of the first end 18, and a second accessory element, such as a nut 30, is set within the tapered interior area 26 of the second end 20.

The flaring of the first end 18 and the second end 20 of the support tube 12 is dimensioned to accommodate a cooperative receipt of support tube accessory elements such as nuts, bolts, hex screws, lag screws, crutch elements, tips, fasteners, heads, or hardware, rubber, or plastic members in any combination or mix or match fashion. In this regard, an outward flaring of the external periphery 24 of the first end 18 and second end 20 defines a tapered interior area 26 which can receive an accessory element in a manner which prevents the accessory element from slipping into the interior 32 of body section 22. The manner of accomplishing the receipt, initial setting, and encapturing of the accessory element in the tapered interior area 26 of support tube 12 will be discussed in detail hereinafter. Thus, the first end 18 of support tube 12 at FIG. 2 can capture the hex-head 34 of bolt 28 in a sealed engagement therein while allowing the stem 36 of the bolt 28 to be exposed external of the support tube 12. In contradistinction, the nut 30 at the second end 20 of support tube 12 is entirely set and sealed within the tapered interior area 26 of the second end.

FIG. 3 is a bottom view of support tube 12 illustrated at FIG. 2 and shows the first end 18 terminating in an inwardly extending flange 38 which defines a retention ring 40 over hex-head 34 of bolt 28 thereby retaining the same in the support tube while allowing stem 36 of the bolt 28 to be externally exposed from the support tube.

FIG. 4 is a top view of the support tube 12 illustrated at FIG. 2 and shows the second end 20 to terminate in an inwardly extending flange 38 which defines a retention ring 40 that encloses an outer portion 42 of nut 30 to thereby retain the same in the tapered interior area 26 of support tube 12 while allowing unimpeded access to the threaded hole 44 of nut 30.

As discussed in greater detail in association with the manufacturing process of the support tube 12, nut 30 and bolt 28 are locked respectively within the first end 18 and the second end 20 by a crimping and flattening of an enclosing portion or lip of an upper portion of each of the first and second ends.

FIG. 5A illustrates a side view of cross piece member 46 cooperative with the support tube to optionally provide additional structural stability to shelf unit assembly 10.

Cross piece member 46 functions as a cross-beam and comprises a central section 48 of arbitrary predetermined length which terminates into a lower head end 50 and an upper head end 52. FIG. 5B is a cross-sectional view of the central section 48 of cross piece member 46 and illustrates the same as being generally U-shaped.

Figure 6:
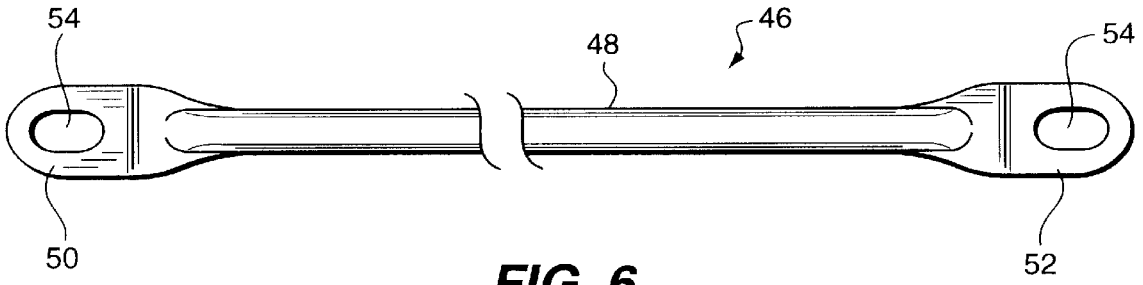
FIG. 6 is a top view of the cross piece member illustrated at FIG. 5A.

As observed in the top view of FIG. 6, lower head end 50 and upper head end 52 of crosspiece member 46 each have a hole 54 therein. As shown in FIG.1, the hole 54 of lower head end 50 can be aligned under and receive the stem 36 of a bolt 28 of a support tube 12. Likewise, the hole 54 of the upper head end 52 can be aligned over a nut 30 of a support tube 12 to receive a stem 36 of another bolt 28 of another cooperative support tube 12. Alternatively, the hole 54 of upper head end 52 can receive a screw, separate bolt, or closure cap cooperative with nut 30 (for example, as in the case of the uppermost shelf 16 at FIG. 1)

Figure 7:
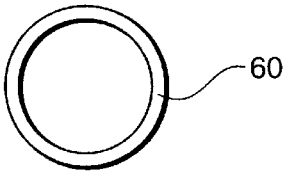
FIG. 7 is an end view of a starting cylindrical tube in the process for manufacturing the same into the support tube of the present invention.

The support tube 12 is made by a three-step manufacturing process involving flaring, crimping, and flattening of a cylindrical tube. Cylindrical tube 60 illustrated at FIG. 7 represents the starting piece for the process. As shown in FIG. 7, cylindrical tube 60 has a uniform diameter to each of its annular ends.

Figure 8:
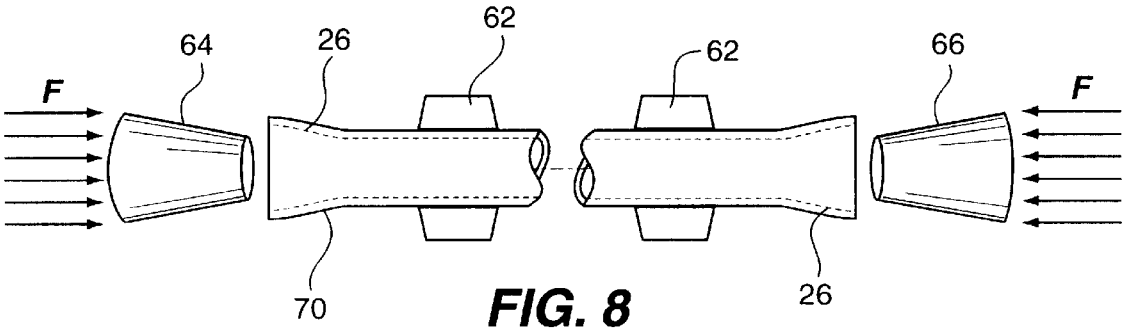
FIG. 8 is a schematic view of the first step of the manufacturing process to make the support tubes of the present invention.

The first step of the manufacturing process of the support tube of the present invention is illustrated in the schematic view of FIG. 8. In FIG. 8, clamp 62 (or alternatively a set block having a receiving surface contoured to receive a cylindrical tube) secures a cylindrical tube 60 as illustrated at FIG. 7. Drive means, such as air or hydraulic press or other means known in the machine arts, provide force F which power drives tapered bullet heads 64 and 66 into the uniform diameter ends of cylinder tube 60 (illustrated at FIG. 7) to thereby outwardly flare each of the ends of the cylindrical tube (as illustrated in FIG. 8) thereby providing a tapered interior area 26 to each end of the tube. Thus, tapered bullet heads 64 and 66 are force inserted into the cylindrical tube 60 to thereby flare the first and second ends of the support tube and also to set the size of the flared ends to accept associated accessory elements. The cylindrical tube 60 illustrated at FIG. 7 deforms into flare tube 70 illustrated at FIG. 8.

Figure 9:
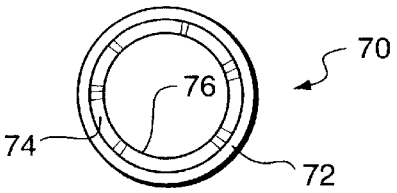
FIG. 9 is an end view of a flare tube resultant from the first step of the manufacturing process.

FIG. 9 is an end view of the flare tube 70 formed by the first step of the manufacturing process schematically illustrated in FIG. 8. The outer flare portion 72 of flare tube 70 illustrated at FIG. 9 is of a greater diameter than the diameter of interior 74 of the body section 76 of flare tube. Flare tube 70 is then submitted to a second manufacturing step which is illustrated in the schematic views of FIGS. 10A and 10B.

Figure 10A:
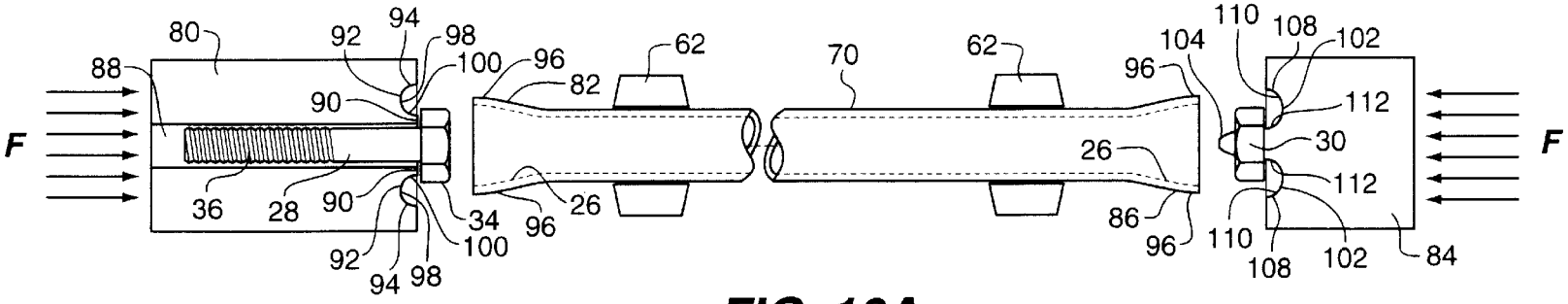
FIGS. 10A and 10B are schematic views of the second step of the manufacturing process for making the support tube of the present invention.
Figure 10B:
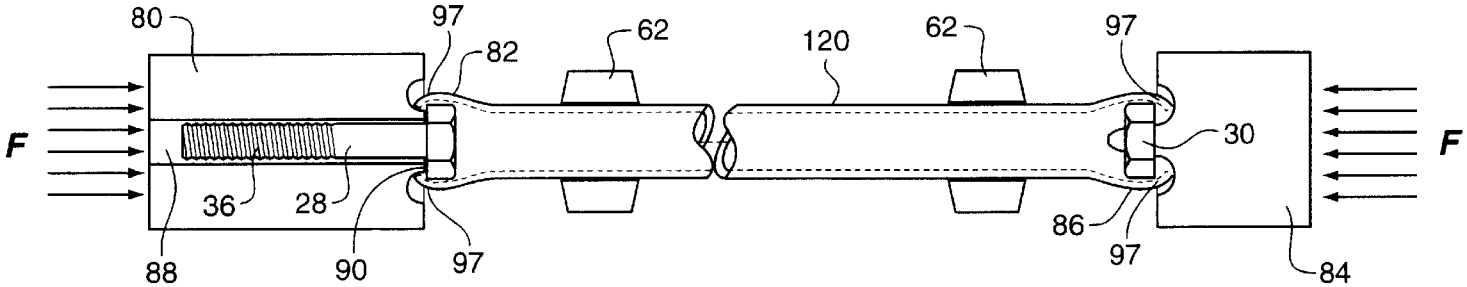

FIGS. 10A and 10B are similar to the schematic process of FIG. 8 except that the aforesaid drive means provide force F which power drives specialized drive arms (shown in lengthwise cross-sectional view) suited for specific accessory elements associated with the flare tube 70 of FIG. 9.

In this regard left bolt drive arm 80 is designed to set bolt 30 into first flared end 82 of flare tube 70 and right nut drive arm 84 is designed to set a nut 30 within second flared end 86 of the flare tube 70. Left bolt drive arm 80 has a bore 88 suited to receive a stem 36 of bolt 28 while supporting the underside of hex-head 34 of bolt 28 upon a shoulder 90 of the left bolt drive arm so that the hex-head of the bolt can be drive set within the first flared end 82 of flare tube 70. Adjoining shoulder 90 of left bolt drive arm 80 is an indented surface 92 which is preferably an u-shaped annular ring. An outer wall surface 94 of the indented surface 92 is designed to encounter lip 96 of the first flared end 82 of flare tube 70 and, by force, crimp and direct the same inward along the inner periphery of the indented surface until the same becomes a crimped lip 97 (see FIG. 10B). Specifically, lip 96 meets an outer wall surface 94 of the indented surface 92 where the drive means force crimps and directs the lip along outer wall surface 94 toward and along a bottom surface 98 and finally to inner wall surface 100 of the indented surface 92. In this way, lip 96 is crimped a predetermined distance in a controlled manner such that the crimped lip 97 extends at least partially over the inserted hex-head 34 of bolt 28 thereby securably holding the same within tapered interior area 26 of flare tube 70. Withdrawal of the drive force retracts the left bolt drive arm 80 from the flare tube 70 leaving the inserted accessory element (hex-head 34 of bolt 28) within the tapered interior area 26 of crimped tube 120 (see FIG. 10B).

Likewise, right nut drive arm 84 has an indented surface 102, which also is preferably an u-shaped annular ring, surrounding an outwardly extending neck 104 that serves as a balance for nut 30. When force drives right nut drive arm 84 into the second flared end 86 of flared tube 70, the outwardly extending neck 104 positions the nut 30 within the tapered interior area 26 of the second flared end of the flare tube while the lip 96 of the second flared end encounters the indented surface 102 such that the force of the drive means crimps and directs the lip 96 along outer wall surface 108 toward and along a bottom surface 110 and finally to inner wall surface 112 of the indented surface 102 in the predetermined distance and controlled manner heretofore discussed until the same becomes a crimped lip 97 (see FIG. 10B). Thus, the lip 96 of second flared end 86 is likewise crimped in a predetermined and controlled manner such that the crimped lip 97 extends at least partially over the inserted nut 30 thereby retaining the same in the tapered interior area 26 of flare tube 70. Withdrawal of the drive force retracts the right nut drive arm 84 from the flare tube leaving the inserted accessory element (nut 30) within the tapered interior area 26 of crimped tube 120 (see FIG. 10B).

The second step of the manufacturing process thus inserts accessory elements into each end of the flared support tube while at the same time allows an indented surface of the drive arms to encounter the outer lip of the ends of the flare tube to deform and crimp the same inwardly a predetermined distance in a controlled manner over the respective accessory elements to at least partially cover the same and thereby secure the accessory elements into a crimped tube upon withdrawal of the drive force.

Figure 11:
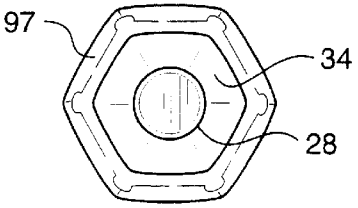
FIG. 11 is an end view of the crimped tube with inserted accessory elements resultant from the second step of the manufacturing process.

FIG. 11 is an end view of the crimped tube 120 with bolt 28 inserted therein after the schematic process of FIGS. 10A and 10B. Crimped lip 97 of the crimped tube 120 partially encloses the hex-head 34 of bolt 28 but not to the extent as illustrated in the corresponding similar view of the final product support tube 12 of FIG. 3.

Figure 12A:
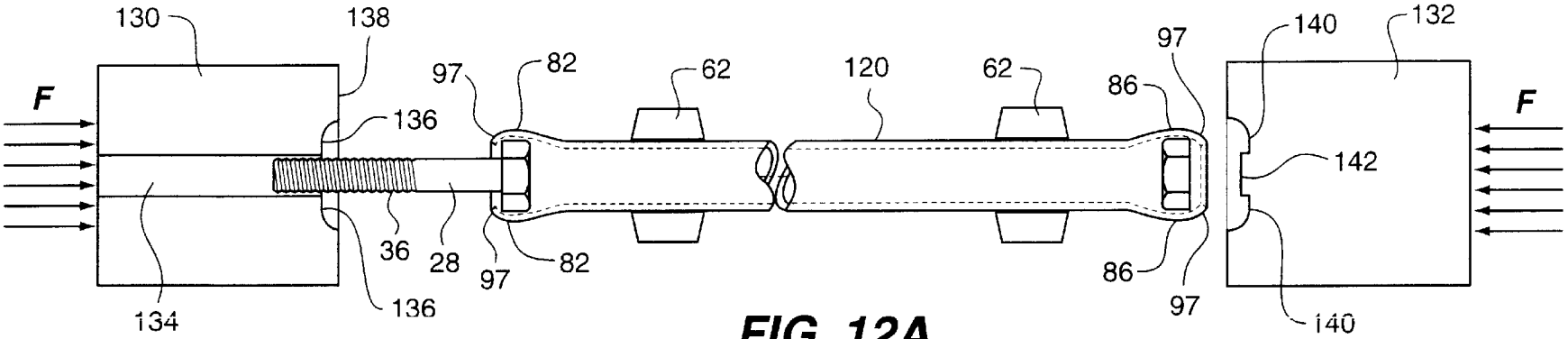
FIGS. 12A and 12B are schematic views of the third step of the manufacturing process for making the support tube of the present invention.
Figure 12B:
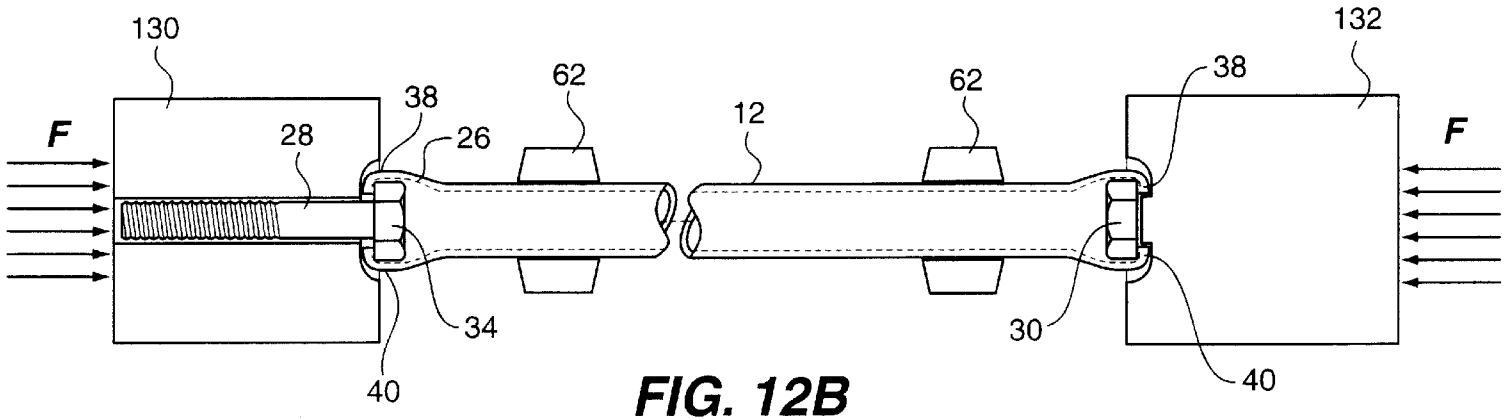

The third step of the manufacturing process is illustrated at FIGS. 12A and 12B. In FIG. 12A the crimped tube 120 with the first accessory element bolt 28 and the second accessory element nut 30 secured therein resultant from the second step of the manufacturing process is placed into clamp 62 and submitted to air or hydraulic or other drive means known in the machine drive arts in a manner similar to the first and second steps of the manufacturing process with the exception that such drive means provide force F which drives left flattening arm 130 and right flattening arm 132 (again shown in lengthwise cross-sectional view).

Left flattening arm 130 has a bore 134 designed to cooperatively receive stem 36 of bolt 28 during drive engagement with the crimped tube 120 and has an indented flattening surface 136 at drive face 138 surrounding the bore. Indented flattening surface 136 is preferably a singular groove of a slightly greater diameter than the crimped lip 97 of first flared end 82 of crimped tube 120 such that when the crimped lip 97 encounters the indented flattening surface, as observed in FIG. 12B, the lip flattens against it and hex-head 34 of bolt 28 to thereby form the inwardly extending flange 38 which defines retention ring 40 heretofore discussed with respect to the final product support tube 12 that permanently seals hex-head 34 of bolt 28 in the tapered interior area 26 of the final product support tube 12.

Likewise, right flattening arm 132 has an indented flattening surface 140 surrounding a stub 142 such that when the same is driven toward the crimped lip 97 of second flared end 86 of crimped tube 120, as observed in FIG. 12B, the same encounters the crimped lip and flattens it against an outer portion of nut 30 to thereby permanently seal the nut within interior tapered area 26 of support tube 12 while leaving the threaded interior area 44 of nut 30 exposed. Stub 142 may be partially driven into the threaded interior area 44 of the nut 30 during this process. The flattening of the crimped lip 97 of the first flared end and the second flared end results in the lips forming the inwardly extending flange 38 which defines an annular retention ring 40 to enclose the associated accessory elements within the tapered interior area 26 of the ends of support tube 12.

In each step of the three-step manufacturing process involving tube flaring, crimping, and flattening illustrated and heretofore described with respect to FIGS. 8, 10A, 10B, 12A, and 12B, the lesser diameter of the interior 32 of tube body section 22 as compared to the outwardly flared first end 18 and second end 20 of the support tube 12 serves as a predetermined limit to the inward positioning of the associated accessory elements.

From the foregoing description, it will be apparent that the support tube, support tube surface area assembly, and the method for manufacture thereof of the present invention has a number of advantages, some of which have been described above and others of which are inherent in the invention. Also, it will be understood that modifications can be made to the support tube, support tube surface area assembly, and method of manufacture therefor or its environment of use described above without departing from the teachings of the present invention. For example, the support tube of the present invention can be varied to be of selected, predetermined, arbitrary lengths and diameter. Also, the accessory elements inserted into the respective ends of the support tube can be of different varieties and combinations of the same (i.e., nut and bolt, bolt and bolt, nut and nut, differing types of bolts, nuts, screws, crutch elements, tips, fasteners, heads, or hardware, rubber, or plastic members and the like). Still further, the support tube can be used in many environments and with many surface areas such as a support for shelves of a bookcase or for compartmental sections or portions of a furniture article such as a computer work station or desk. Indeed, the bookcase assembly of FIG. 1 is a preferred illustrative assembly embodiment using the component support tube of the present invention, yet any assembly having a bored surface area (such a shelf board, a panel, a portion of a furniture piece, a leg, or other like structure) can cooperate with the support tube of the present invention to use the same as a support or tie rod or brace. Accordingly, the scope of the invention is only to be limited as necessitated by the accompanying claims.

We claim:

1. A support tube comprising a first end, a second end, and a body section extending therebetween, said first end and said second end each being outwardly flared at their external side periphery to provide a tapered interior area to said first end and said second end, a first accessory element set within said tapered interior area of said first end, a second accessory element set within said tapered interior area of said second end, said first end and said second end each terminating into an inwardly extending flange forming a retention ring to at least partially enclose said first accessory element and said second accessory element within said tapered interior area of said first end and said second end.

2. The support tube of claim 1 wherein one of said first accessory element or said second accessory element is a bolt.

3. The support tube of claim 1 wherein one of said first accessory element or said second accessory element is a nut.

4. The support tube of claim 1 wherein one of said first accessory element or said second accessory element is a screw.

5. The support tube of claim 1 wherein one of said first accessory element or said second accessory element is a bolt and the other is a nut.

6. The support tube of claim 1 further including a cross-piece member attached thereto.

7. A support tube assembly comprising a support tube having a first end, a second end, and a body section extending therebetween, said first end and said second end each being outwardly flared at their external side periphery to provide a tapered interior area to said first end and said second end, a first accessory element set within said tapered interior area of said first end, a second accessory element set within said tapered interior area of said second end, said first end and said second end each terminating into an inwardly extending flange forming a retention ring to at least partially enclose said first accessory element and said second accessory element within said tapered interior area of said first end and said second end, and a surface area having a bore therein, said bore being dimensioned to cooperate with at least one of said first accessory element or said second accessory element so as to foster attachment of said support tube to said surface area.

8. The support tube assembly of claim 7 wherein said surface area is a panel.

9. The support tube assembly of claim 8 further including a plurality of support tubes to support a plurality of panels.

10. The support tube assembly of claim 7 wherein said surface area comprises a portion of a furniture article.

11. The support tube assembly of claim 10 further including a plurality of support tubes to support said portion of a furniture article.

12. A method for manufacture of a support tube comprising the steps of: flaring both ends a of cylindrical tube to thereby form a flare tube having an first end, a second end, and a body section extending therebetween, said first end and said second end each being outwardly flared at their external side periphery to provide a tapered interior area to said first end and said second end; placing a first accessory element at least partially into the tapered interior area of said first end of said flare tube; placing a second accessory element at least partially into the tapered interior area of said second end of said flare tube; crimping a portion of the first end of said flare tube at least partially over said first accessory element and crimping a portion of the second end of said flare tube at least partially over said second accessory element thereby forming a crimped flare tube; flattening said crimped portions of said first end and said second end of said crimped flare tube to thereby form an inwardly extending flange to the outer ends of said first end and said second end to retain said first accessory element and said second accessory element.

13. The method for manufacture of a support tube of claim 12 wherein the flaring of both ends of said cylindrical tube is achieved by the driving of a tapered head into each of said ends of said cylindrical tube.

14. The method for manufacture of a support tube of claim 13 wherein said tapered head is bullet-shaped.

15. The method for manufacture of a support tube of claim 13 wherein the crimping of a portion of either the first end or second end of said flare tube is achieved by the driving of an arm having an indented surface into an end of said flare tube such that said indented surface encounters a lip of said first or second end of said flare tube and partially inwardly crimps the same to thereby at least partially enclose an inserted accessory element.

16. The method for manufacture of a support tube of claim 15 wherein said indented surface of said arm has a defined depth and width to control the degree of crimping of a portion of either the first end or second end of said flare tube when encountering said lip of said first or second end of said flare tube and partially inwardly crimping the same.

17. The method for manufacture of a support tube of claim 16 wherein said indented surface of said arm forms an outer wall surface, a bottom surface, and an interior wall surface, said control of the degree of crimping of a portion of either the first end or second end of said flare tube occurring when said lip of said first or second end of said flare tube encounters said outer wall surface and is forced inward of the same toward said bottom surface and toward said interior wall surface.

18. The method for manufacture of a support tube of claim 16 wherein said indented surface of said arm is a u-shaped annular ring.

19. The method for manufacture of a support tube of claim 18 wherein said u-shaped annular ring surrounds an outwardly extending neck of said arm.

20. The method for manufacture of a support tube of claim 19 wherein said outwardly extending neck is dimensioned to receive an accessory element.

21. The method for manufacture of a support tube of claim 20 wherein said accessory element received by said outwardly extending neck is inserted into said flare tube during said controlled degree of crimping of a portion of either the first end or second end of said flare tube and is withdrawn from said outwardly extending neck.

22. The method for manufacture of a support tube of claim 18 wherein said u-shaped annular ring surrounds a bore of said arm.

23. The method for manufacture of a support tube of claim 22 wherein said bore is dimensioned to receive an accessory element.

24. The method for manufacture of a support tube of claim 22 wherein said accessory element received in said bore is inserted into said flare tube during said controlled degree of crimping of a portion of either the first end or second end of said flare tube and is withdrawn from said bore.

25. The method for manufacture of a support tube of claim 12 wherein the flattening of a crimped portion of either the first or second end of said crimped flare tube is achieved by the driving of an arm having an indented flattening surface against said crimped flare tube such that said indented flattening surface encounters said crimped portion and flattens the same against an externally facing surface of said first or second accessory element.

26. The method for manufacture of a support tube of claim 25 wherein said indented flattening surface borders a bore of said arm.

27. The method for manufacture of a support tube of claim 26 wherein said bore is dimensioned to receive a portion of an accessory element externally extending from said crimped flare tube.

28. The method for manufacture of a support tube of claim 25 wherein said indented flattening surface borders a stub of said arm.

* * * * *